United States Patent [19]

Burton

[11] 4,294,610

[45] Oct. 13, 1981

[54] FOUNDRY COKE

[75] Inventor: Edward D. Burton, Chesterfield, Mo.

[73] Assignee: Great Lakes Carbon Corporation, New York, N.Y.

[21] Appl. No.: 93,547

[22] Filed: Nov. 13, 1979

Related U.S. Application Data

[63] Continuation of Ser. No. 896,579, Apr. 14, 1978, abandoned.

[51] Int. Cl.[3] ..... C04B 7/02

[52] U.S. Cl. ..... 75/43; 75/58; 75/93 R; 75/130 R

[58] Field of Search ..... 75/43, 48, 57, 93 R, 75/129, 130 R; 106/97; 201/21

[56] References Cited

U.S. PATENT DOCUMENTS 2,527,829 10/1950 Leitten ..... 75/57

FOREIGN PATENT DOCUMENTS 714099 11/1941 Fed. Rep. of Germany .
980214 1/1965 United Kingdom .

*Primary Examiner*—P. D. Rosenberg
*Attorney, Agent, or Firm*—Adrian J. Good

[57] ABSTRACT

An effective amount of silicon carbide, preferably mixed with graphite, is added to the blend of coals used to make a foundry coke, the blend is thoroughly mixed, pulverized, and coked in a by-product coke oven. The resulting coke has improved physical and chemical properties allowing production of gray iron with less fuel. Gray iron castings with improved hardness control at lower cost are produced by the inoculating effect of the silicon from silicon carbide and graphite in the mixture.

9 Claims, No Drawings

FOUNDRY COKE

This is a continuation of application Ser. No. 896,579, filed Apr. 14, 1978, now abandoned.

BACKGROUND OF THE INVENTION

Iron, the commonest and most useful metal, is always used commercially in the alloyed form, as its properties can be varied as to hardness, ductility, flexibility, tensile strength, chemical resistance, and other properties by the choice, amounts, and combination of alloying elements. Gray cast iron is distinguished by a relatively high amount of carbon, approximately 3%, which imparts to it the characteristic hardness, castability, wear resistance, and machinability displayed by no other metal.

Gray cast iron is unique in its high content of carbon, and in the form of a large portion of this carbon as a separate phase of graphite. The strength, wear resistance, bittleness or conversely toughness, and machinability are all controlled to a large and primary extent by the graphitic carbon content. Graphite in gray iron appears in several forms well-known to the foundry metallurgist, of which the so-called type A, a flake, is preferred, in a pearlitic iron matrix. If the carbon is present as iron carbide, or cementite, the metal will be what is known as white iron, hard, brittle, and unmachinable. If the carbon is present in the correct proportion as graphite in the pearlitic matrix, it will display the characteristic gray color and good machinability of gray iron.

(This treatment ignores the effects of the other alloying elements and heat treatment and will be limited to the effects of silicon and carbon upon the properties of gray cast iron, in order to simplify its complex subject matter.)

When gray iron is melted in a cupola over a bed of hot coke, it gains some carbon content from the coke, which may be varied by adjusting the coke-iron ratio, the air blast, by additives such as silicon, and by the slag chemistry.

When it is poured into the molds to produce parts, the utility of these parts is affected by the cooling rate, and the rate of precipitation from solution of the various forms of iron. An iron melt which hardens too quickly will have an excess of iron carbide and have the characteristics of white iron, hard, brittle, poorly machinable, and relatively strong.

If the iron has an excess of carbon as graphite with the metal predominantly in the form of primary ferrite from a too slow cooling rate, the metal will have low tensile strength and be too soft to be commercially useful.

The amount and shape, size, and distribution of graphite present in a gray cast iron are usually controlled by the addition of an inoculant to the metal in the cupola, the ladle, or the mold which furnishes seeds for formation of crystals of graphite. Inoculants commonly used are silicon in various forms, such as ferrosilicon or silicon carbide, and graphite itself. Other metals used include chromium, manganese, calcium, titanium, zirconium, aluminum, barium and strontium.

Some of the elements function as alloying elements as well, in particular molybdenum, chromium, and manganese. Aluminum and the alkaline earths are the most effective non-graphitic inoculants.

Silicon is the principal element used as an inoculant, controlling graphite formation, allowing the formation of the pearlitic iron matrix over a wider temperature range, and thus decreasing the chill depth of the cast metal.

The chill depth test is usually conducted by casting a graduated wedge-shaped test piece under specific conditions, and measuring the extent of the white iron from the tip of the wedge. Since the thinner portion cools faster, the tip will be of white iron or iron carbide, which will crystallize earliest, and is light colored, hard, brittle and unmachinable in normal operation. The extent of the chill depth controls principally the thickness of the casting which can be made from a particular melt, a melt with a low chill depth enabling a relatively thinner casting to be poured without the formation of white iron. A thick cross-sectioned casting is made with iron with a greater chill depth to avoid the formation of excess graphite and ferrite. The desired metal consists of graphite flakes in a matrix of pearlitic iron, which is stabilized over a widely varying cooling rate.

Past practice in this area has shown the use of silicon carbide as an added ingredient in the cupola charge or to the ladle by U.S. Pat. No. 2,020,171 and U.S. Pat. No. 2,119,521 to Brown.

The use of silicon carbide in briquette form is shown by U.S. Pat. No. 2,497,745 to Stohr; U.S. Pat. No. 2,527,829 to Leitten; U.S. Pat. No. 3,051,564 to Drenning; and U.S. Pat. No. 3,666,445 to Stone et al. U.S. Pat. No. 4,015,977 to Crawford claims briquettes of petroleum coke with refractory oxides or a derivative which will yield a metal oxide.

A clear explanation of the use of silicon carbide in gray iron melts is given by Moore, U.S. Pat. No. 3,764,298, showing desirable and undesirable grain structures and chill wedges with small additions of silicon carbide to the metal.

The commercial silicon carbide used in the practice of this invention is a by-product of the Acheson graphite process. When baked carbon electrodes are packed with resistor coke and then covered with a coke-silica mixture and electrically heated to transform the amorphous carbon to crystalline graphite, some of the silica reacts with carbon forming silicon carbide according to the following equation:

$$SiO_2+2C \rightarrow SiC+CO_2.$$

The commercial grade used in this invention contains approximately 50% to 60% graphite and 20–25% silicon carbide with the remainder a mixture of silicon dioxide and other metallic oxides.

SUMMARY OF THE INVENTION an effective amount of a composition consisting principally of graphite and silicon carbide, such as is available as a by-product of graphite manufacture in the well known Acheson process, is added to the blend of coals used in making foundry coke. The mix is pulverized and coked in a by-product coke oven (see: Making Efficient Use of Coke in the Cupola, American Coke and Coal Chemicals Institute, Washington, D.C.).

The resulting coke has superior physical and chemical properties. Its superior hot strength gives improved operation in the cupola; aids in maintaining the physical integrity of the coke in the cupola, avoiding breakdown into smaller particles and consequent plugging which increases the back pressure of the air draft necessary to maintain smooth operation of the cupola. This in turn contributes to operation with less fuel and consequent savings.

The silicon carbide decomposes in the hot metal, releasing exothermic heat and lowering the overall coke combustion.

When the silicon carbide is blended into the coal mix, preferably in combination with graphite powder, and consequently pulverized and coked, it is dispersed much more uniformly and homogeneously within the coke particles and is more uniformly and readily available to the liquid iron at the coke-iron interface. This availability aids in promoting the reactions of decomposition of the silicon carbide and its reactions with the iron.

The availability of the silicon carbide in the coke also aids in simplifying the operation of the cupola in lessening the need for additional inoculants, reducing labor needed and the possibility of weighing and adding errors.

The graphite, and silicon from the silicon carbide, act as inoculants for deposition of graphite in the desired pearlitic matrix on cooling and hardening of the metal when cast, thus controlling the grain structure, hardness, strength and machinability of the cast metal, enabling the founder to produce thinner cross-section castings economically and profitably.

DETAILED DESCRIPTION OF THE INVENTION

From 1–10% of a commercial grade of impure silicon carbide containing graphitic carbon is added to the mix of coking coals in a physical blend, the mix pulverized and coked in a convertional by-product coke oven.

The coke produced in the above fashion is used as a replacement for the regular metallurgical coke in a gray iron foundry cupola.

EXAMPLE 1

To 95 parts by weight of a mixture of coking and non-coking coals 5 parts of commercial silicon carbide was added.

The silicon carbide used had the following approximate analysis:

C—50–60% (Graphitic)
$SiO_2$—9–15%
SiC—19–25%
MeO—12–15% (mixed metal oxides)

This mixture was blended, pulverized, loaded into a by-product coke oven and coked during a 26½ hour cycle. The coke produced had the following analysis by various samples:

| | Silicon Carbide Coke | Regular Coke (Typical) |
|---|---|---|
| Volatile Matter | 0.7–0.85% | 0.65% |
| Fixed Carbon | 90–92% | 92.2% |
| Ash | 8–9% | 7.2% |
| Sulfur | 0.55% | 0.52% |
| SiC | 0.5–0.8% | .05% |
| ASG* | .945 | .935 |
| BTU/lb. | 12,500–13,400 | 12,500–13,500 |

*Apparent Specific Gravity

This coke was used in a gray iron cupola in a jobbing foundry with a daily melt of approximately 70 tons of gray iron, with the following results reported:

1—Approximately 5–10% less coke was required for melting.
2—Silicon gain in the metal was approximately 0.10% at a 6 to 1 coke ratio (wt. iron to coke).
3—Back pressure in the cupola was reported to be less variable than in the past.
4—Carbon pickup in the iron increased considerably at normal coking levels.
5—Melting rates and metal temperature were equal to or slightly higher than with regular coke.

Nos. 3, 4 and 5 above were qualitative determinations only and were not quantitatively determined.

The reduction in back pressure was the result of a higher hot strength by the coke, which maintained its physical integrity while burning, and for that reason offered less resistance to the air flow.

The fact that the melt rate and metal temperature were equal to or slightly higher than with regular coke verified that the silicon carbide reacted in the melt, releasing heat. The reactions are:

$$SiC \rightarrow Si \;\&\; C$$

$$MnO \;\&\; SiC \rightarrow CO_g \;\&\; Si \;\&\; Mn \;\&\; \Delta H$$

$$FeO \;\&\; SiC \rightarrow CO_g \;\&\; Si \;\&\; Fe \;\&\; \Delta H$$

EXAMPLE 2

Ten carloads of coke were made as in Example 1 with 5% of the same type silicon carbide in the blend. The coke produced had a composite analysis as follows:

| | |
|---|---|
| Volatile Matter | 1.00% |
| Fixed Carbon | 91.47% |
| Ash | 7.59% |
| Sulfur | .59% |

The above coke was used in a four day run in a 90" diameter, water-walled, refractoryless front slagging cupola with water cooled projecting tuyeres, and a carbon lined wall. Typical operating data for this cupola during this run was:

1—Bed height—60" above centerline of tuyeres.
Bed coke weight—9,000 lbs.
Limestone—500 lbs.
2—Stack holding capacity—10–12×6,000 lb. charges.
3—Typical cupola charges:
A—Running charge

| | |
|---|---|
| Steel | 1,100 lbs. |
| Returns | 3,160 lbs. |
| 50% Ferrosilicon | 140 lbs. |
| 50% Borings/50% Steel Briquettes | 1,600 lbs. |
| TOTAL | 6,000 lbs. |

B—Start-up charge

| | |
|---|---|
| Steel | 2,000 lbs. |
| 50% Ferrosilicon | 200 lbs. |
| Steel Turnings Briquettes | 1,800 lbs. |
| TOTAL | 4,000 lbs. |

C—Coke Charge

| | |
|---|---|
| Coke (SiC) | 650 lbs. |
| Coke (Regular) | 700 lbs. |
| Running Coke to Iron Ratio 9 to 1 | |

D—Limestone

| | |
|---|---|
| Charge | |
| Start-up Charge | 50 lbs. |
| Regular | 150 lbs. |

E—

| | |
|---|---|
| Blast Rate | 16,500 cfm |
| Back pressure | 40 ozs. |

4. Melting Rate—32–41 T/hr.

5. Metal Composition

The iron produced with the coke containing SiC had the following analysis as compared to iron produced with regular coke:

Typical Metal Composition:

| | Regular Coke | SiC Coke |
|---|---|---|
| Silicon | 2.34% | 2.30% |
| Charged Silicon | 2.71% | 2.60% |
| Silicon Melting Loss | 0.37% | 0.30% |
| Carbon | 3.35% | 3.36% |
| Manganese | 0.64% | 0.63% |
| Sulfur | 0.120–0.160% | 0.120–0.145% |
| Brinnell Hardness-Mean | 223 | 218 |
| Chill Depth-Mean | 6.7 (1/32") | 6.3 (1/32") |

In this test, there was an overall reduction in coke use of 6.2%. The running coke charge, not including booster charges or bed coke was reduced from 700 lbs. to 650 lbs. or 7.1%.

These reductions in charged coke did not reduce carbon gain or pickup by the iron.

Silicon melting loss of oxidation loss was reduced 18.9%. Silicon pickup in the iron was 0.07%.

There was a reduction in hardness and in chill depth apparent in this test, indicating the effectiveness of the graphite and silicon carbide as inoculants.

From the above data, it can readily be observed that the use of this coke results in improvement of operation of a cupola by lowering the consumption of coke needed to melt the iron, or conversely, increasing the production rate, and lessening the amount of the expensive ferrosilicon alloy needed.

Back pressure in the above run was also reduced and more uniform than in previous runs, indicating that this coke broke down less in the cupola and had higher hot strength than regular coke.

I claim:

1. A coke suitable for use as fuel in a foundry cupola to produce gray iron, said coke containing uniformly distributed throughout its structure from 0.5 to 2.5% by wt. of silicon carbide effective to act as a deoxidizer and inoculant during the melting of said gray iron and which is blended with the coal used to produce said coke prior to coking said coal.

2. A method of producing an improved grade of coke particularly suitable for use as fuel and which acts as deoxidizer and inoculant in a gray iron foundry cupola, which comprises uniformly mixing from 0.5 to 2.5% by wt. of silicon carbide with the coal prior to coking of said coal.

3. In a coke made from coal and suitable for use as fuel in a foundry cupola to produce gray iron, the improvement comprising the addition of from 0.5 to 2.5% silicon carbide and 0.5 to 6.0% graphite by wt. based on the amount of coal effective to act as deoxidizer and inoculants during the melting of said gray iron, to the coal used to produce said coke prior to coking the said coal in a by-product coke oven.

4. The coke of claim 3, wherein the silicon carbide and graphite are added as a commercial grade of silicon carbide obtained as a by-product of the manufacture of graphite by the Acheson Process, said by-product having approximately 20 to 25% silicon carbide and 50 to 60% graphite content by wt.

5. The method of claim 2, using a commercial grade of silicon carbide containing from 20 to 25% silicon carbide and from 50 to 60% graphite.

6. The coke of claim 1 with from 0.5 to 2.5% by wt. silicon carbide based on the amount of coal.

7. The coke of claim 3 with from 0.5 to 2.5% by wt. silicon carbide and from 0.5 to 6.0% by wt. graphite based on the amount of coal.

8. A method of producing an improved grade of coke particularly suitable for use as fuel and which acts as a deoxidizer and inoculant in a gray iron foundry cupola, which comprises mixing an effective amount of silicon carbide with the coal prior to coking of said coal.

9. The method of claim 8 with from 0.5 to 2.5% by wt. silicon carbide based on the amount of coal.

* * * * *